US007730811B2

(12) United States Patent
Robinson et al.

(10) Patent No.: US 7,730,811 B2
(45) Date of Patent: Jun. 8, 2010

(54) CLAMPING AND CUTTING APPARATUS WITH INTERCHANGEABLE HEADS

(75) Inventors: Glenn Robinson, Coral Springs, FL (US); Dan M. De La Rosa, Coral Springs, FL (US)

(73) Assignee: IBT Holdings, Inc., Deerfield Beach, FL (US)

( * ) Notice: Subject to any disclaimer, the term of this patent is extended or adjusted under 35 U.S.C. 154(b) by 0 days.

(21) Appl. No.: 11/982,200

(22) Filed: Nov. 2, 2007

(65) Prior Publication Data

US 2009/0113721 A1 May 7, 2009

(51) Int. Cl.
*B25B 7/02* (2006.01)

(52) U.S. Cl. ..... 81/423; 81/415

(58) Field of Classification Search ..... 81/423, 81/415, 418, 421, 422, 416, 427.5; 403/199, 403/376, 408.1

See application file for complete search history.

(56) References Cited

U.S. PATENT DOCUMENTS

| | | | | |
|---|---|---|---|---|
| 208,878 | A | 10/1878 | Allen et al. | |
| 251,464 | A * | 12/1881 | Rogers | 403/408.1 |
| 816,674 | A | 4/1906 | Medhus | |
| 1,005,661 | A | 10/1911 | Shirt | |
| 1,079,997 | A | 12/1913 | Wemimont | |
| 1,334,425 | A | 3/1920 | Wemimont | |
| 1,455,297 | A | 5/1923 | Lyons et al. | |
| 1,505,510 | A | 8/1924 | Uhl | |
| 1,556,755 | A | 10/1925 | Burman | |
| 2,606,471 | A | 8/1952 | Kollweck | |
| 3,132,550 | A | 5/1964 | Sion | |
| 3,523,395 | A * | 8/1970 | Konrad et al. | 403/408.1 |
| 3,652,045 | A * | 3/1972 | Hirt | 403/376 |
| 4,198,749 | A | 4/1980 | Nordin | |
| 5,430,941 | A | 7/1995 | Lin | |
| 5,664,274 | A | 9/1997 | Collins | |
| 5,735,005 | A | 4/1998 | Wang | |
| 6,023,805 | A | 2/2000 | Lin | |
| 6,088,860 | A | 7/2000 | Poehlann et al. | |
| 6,108,845 | A | 8/2000 | Hung et al. | |
| 6,131,495 | A | 10/2000 | Chen | |
| D433,902 | S | 11/2000 | Rivera | |
| 6,145,144 | A | 11/2000 | Poehlmann et al. | |
| 6,223,374 | B1 | 5/2001 | Lin | |
| 6,226,822 | B1 * | 5/2001 | Chen | 81/416 |
| 6,250,184 | B1 * | 6/2001 | Chang | 81/415 |
| 6,282,995 | B1 | 9/2001 | Lin | |
| 6,305,041 | B1 | 10/2001 | Montague et al. | |
| 6,336,387 | B1 | 1/2002 | Lee | |
| 6,405,395 | B1 | 6/2002 | Poehlmann et al. | |
| 6,523,203 | B2 | 2/2003 | Harrison | |
| 6,612,147 | B2 | 9/2003 | Beetz et al. | |
| 6,643,877 | B1 | 11/2003 | Amtenbrink et al. | |
| 6,647,835 | B1 | 11/2003 | Tseng | |

(Continued)

*Primary Examiner*—Hadi Shakeri
(74) *Attorney, Agent, or Firm*—Dan De La Rosa

(57) ABSTRACT

An interchangeable head system for tools is provided. The system includes a pair of handles connected at a pivot point. Each handles has two generally parallel walls forming a space therebetween, and a moveable pin attached therethrough. The pin is non-removably attached to one of the walls. A plurality of heads interchangeably connected at the pivot point. Each heads includes two components and each component includes two contact surfaces. The movable pin facilitates securing the head to the handle. The handles are designed to be squeezed together to thereby allow the contact surfaces to move towards one another.

9 Claims, 6 Drawing Sheets

U.S. PATENT DOCUMENTS 6,721,983 B2 4/2004 Dallas
6,983,506 B1 1/2006 Brown
2008/0072716 A1* 3/2008 Chen ..... 81/423

* cited by examiner

CLAMPING AND CUTTING APPARATUS WITH INTERCHANGEABLE HEADS

BACKGROUND OF THE INVENTION

1. Field of the Invention

This invention relates to a clamping, cutting and/or clipping apparatus and more particularly, pliers and snips with interchangeable heads. The present invention provides for a device having an interchangeable head, and the device comprises: a pair of handles having opposing top and bottom ends, the top end of each of the handles is connected at a pivot point, and each of the top ends of the handles have two generally parallel walls forming a space therebetween, and the first wall has a moveable pin attached therethrough and the second wall has an aperture to receive the moveable pin. The device also comprises a head comprising a first and second component, each of the components has opposing top and bottom ends, and the top end of each of the components has at least one contact surface, and the first and second components are connected at a pivot point, and the bottom end of each of the components comprises at least one aperture designed to align with the aperture of the second wall of one of the top ends of the handle and to receive the moveable pin during an installment position, and each of the bottom ends of the components of the head is inserted within the space formed by the walls of the top ends of the handles, and the pin is inserted through the aperture of the bottom end of the head and the aperture of the top end of the handle. The device further comprises a means for securing the pin to the handle to thereby secure said head to the handle, and the handles are designed to be squeezed together to thereby allow the contact surfaces of the first and second top ends of the first and second components to move towards one another.

2. Description of the Related Art

There are various patents covering pliers type devices with interchangeable heads or components. These pliers type devices are difficult to use, the heads are difficult to change and most importantly, changing the head becomes dangerous for the user. FIG. 1 shows a typical pliers device 100 with interchangeable head 101. The device 100 has two handles 102*a* and 102*b*, respectively, connected at a pivot point 103 and at least two stationary pins 104. The head 101 has two components and each component has a top end 105 with a clamping surface 106 and a crescent shaped bottom 109. To install the head 101, the handles, 102*a* and *b*, must be pulled apart and the crescent shaped bottoms 109 are then attached to the stationary pins 104 and then the handles, 102*a* and *b*, are squeezed toward one another to secure the head 101 to the handles 102*a* and *b*. This typical device is difficult to use and changing the heads is extremely awkward and cumbersome.

FIG. 2 relates to the pliers device 200 shown in U.S. Pat. No. 6,336,387 by Lee. Lee has two handles, 202*a* and *b* respectively, and the handles meet at a pivot point 203 and each handle has an extended portion 207 with a stationary pin 204. The portions 208 are situated above the pivot point 203. The interchangeable head 201 has two components and each component has a top end 205 with a clamping surface 206 and a bottom end 210 with a crescent shaped bottom 209 and each component is attached at pivot point 208. To install the head 201, the handles, 202*a* and *b*, must be pulled apart and the crescent shaped bottoms 209 are then attached to the stationary pins 204 and then the handles, 202*a* and *b*, are squeezed toward one another to secure the head 201 to the handles 202*a* and *b*. Like the first pliers discussed above, the Lee device is also difficult and dangerous to use when changing heads.

U.S. Pat. No. 6,612,147 to Beetz et al. is another complicated interchangeable head device. The Beetz device is similar to the Lee device with regards to the handle but there is a separate extended portion attached below the pivot point of the device. The extended portion has two ends, one end attached to the handle and the other end is to be attached to the interchangeable head. The extended portions are moveable and unstable and requires another component to prevent movement to the two extended portions.

Unlike the prior art, the present invention provides for pliers and clippers as well as clamping and cutting devices with interchangeable heads with improved interchangeability designs and safety features. Most importantly, the present invention provides for an improved device that is easy to change the heads and is safer for the user to work with. In addition, the present invention also provides for various head functions and designs such as different heads for cutting, snipping and clamping.

SUMMARY OF THE INVENTION

In one embodiment, the present invention provides for a device having an interchangeable head, the device comprises: a pair of handles having opposing top and bottom ends, the top end of each of the handles is connected at a pivot point, and each of the top ends of the handles have two generally parallel walls forming a space therebetween, and the first wall has a moveable pin attached therethrough and the second wall has an aperture to receive the moveable pin; a head comprising a first and second component, each of the components has opposing top and bottom ends, and the top end of each of the components has at least one contact surface, and the first and second components are connected at a pivot point, and the bottom end of each of the components comprises at least one aperture designed to align with the aperture of the second wall of one of the top ends of the handle and to receive the moveable pin during an installment position, and each of the bottom ends of the components of the head is inserted within the space formed by the walls of the top ends of the handles, and the pin is inserted through the aperture of the bottom end of the head and the aperture of the top end of the handle; and a means for securing the pin to the handle to thereby secure the head to the handle, and the handles are designed to be squeezed together to thereby allow the contact surfaces of the first and second top ends of the first and second components to move towards one another.

In another embodiment, the device of the present invention further comprises a spring situated between the handles.

In still another embodiment, the contact surfaces of the device function as clamping contact surfaces, and the device functions as a clamping device. In yet another embodiment, the clamping device functions as pliers. In still yet another embodiment, each of the contact surfaces of the first and the second top ends of the first and second components comprise cutting surfaces, and the device functions as a cutting device. In a further embodiment, the cutting device functions as snips. In yet a further embodiment, the cutting device functions as scissors.

In still a further embodiment, the device of the present invention further comprises a locking device and one end of the locking device is connected to one of the moveable pins.

In still yet a further embodiment, the opposing end of the locking device comprises at least one latch, and the latch is designed to hook onto the second pin during a locked position wherein the contact surfaces of the first and second components of the head are connected to one another.

In another embodiment, the present invention provides for an interchangeable head system for tools, the system comprises: a pair of handles having opposing top and bottom ends, and the top end of each of the handles is connected at a pivot point, and each of the top ends of the handles has two generally parallel walls forming a space therebetween, and the first wall has a moveable pin attached therethrough and the second wall has an aperture to receive the moveable pin; a plurality of heads, each head comprising a first and second component, each of the components has opposing top and bottom ends, and the top end of each of the components has at least one contact surface, and the first and second components is connected at a pivot point, and the bottom end of each of the components comprises at least one aperture designed to align with the aperture of the second wall of one of the top ends of the handle and to receive the moveable pin during an installment position, each of the bottom ends of the components of the head is inserted within the space formed by the walls of the top ends of the handles, and the pin is inserted through the aperture of the bottom end of the head and the aperture of the top end of the handle; and a means for securing the pin to the handle to thereby secure the head to the handle, and the handles are designed to be squeezed together to thereby allow the contact surfaces of the first and the second top ends of the first and second components to move towards one another.

In still another embodiment, the system further comprising a spring situated between the handles. In yet another embodiment, the contact surfaces of the components of the system function as clamping contact surfaces, and the tool functions as a clamping device. In still yet another embodiment, the clamping device functions as pliers.

In a further embodiment, each of the contact surfaces of the first and second top ends of the first and second components comprise cutting surfaces, and the tool functions as a cutting device. In another further embodiment, the cutting device functions as snips.

In still another further embodiment, the system further comprises a locking device, and one end of the locking device is connected to one of the moveable pins. In yet another further embodiment, the opposing end of the locking device comprises at least one latch, and the latch is designed to hook onto the second pin during a locked position wherein the contact surfaces of the first and second components of the head are connected to one another.

In still yet another further embodiment, the present invention relates to a hardware device having an interchangeable head system, the device comprises: a pair of handles having opposing top and bottom ends, the top end of each of the handles is connected at a pivot point, each of the top ends of the handles has two generally parallel walls forming a space therebetween, and the first wall has a moveable pin attached therethrough and the second wall has an aperture to receive the moveable pin; a spring situated between the handles; an interchangeable head system comprising at least two heads, each head comprising a first and second component, each of the components has opposing top and bottom ends, and the top end of each of the components has at least one contact surface, and the first and second components are connected at a pivot point, and the bottom end of each of the components comprises at least one aperture designed to align with the aperture of the second wall of one of the top ends of the handle and to receive the moveable pin during an installment position, each of the bottom ends of the components of the head is inserted within the space formed by the walls of the top ends of the handles, and the pin is inserted through the aperture of the bottom end of the head and the aperture of the top end of the handle; and a means for securing the pin to the handle to thereby secure the head to the handle, and the handles are designed to be squeezed together to thereby allow the contact surfaces of the first and the second top ends of the first and second components to move towards one another.

In another further embodiment, the contact surfaces of the components of the interchangeable head system of the present invention function as clamping contact surfaces, and the device functions as a clamping device.

In a further embodiment, each of the contact surfaces of the first and the second top ends of the first and second components comprise cutting surfaces, and the device functions as a cutting device.

In still yet another embodiment, the device comprises a means for securing the pin to the handle and the head to the handle or pin securing devices. In another embodiment, the moveable pin has opposing ends, one end has a threaded portion and the opposing end has at least one stop. The moveable pin is attached to the first wall of the top end of the handles and is moveable through an aperture in the first wall. In still another embodiment, the second wall comprises a cap with a cavity having grooves for receiving the treaded portion of the moveable pin during an installed position. In yet another embodiment, the second wall has an aperture leading to a cap with a cavity having grooves for receiving the treaded portion of the moveable pin during an installed position. The stop of the pin is designed to also secure the pin into the aperture of the second wall. The pin is secured using a screw or twist mechanism.

In a further embodiment, the moveable pin has opposing ends, one end has an extended portion and the opposing end has at least one stop. The moveable pin is attached to the first wall of the top end of the handles and is moveable through an aperture in the first wall. In still another further embodiment, the second wall of the top end of the handles and the bottom end of each of the components comprise an aperture with an extended cavity designed to fit the extended portion of one end of the pin. The pin with the extended portion is inserted into the apertures with extended cavity and then the pin is secured with a lock and key mechanism.

In another embodiment, the moveable pin has opposing ends, one end has a groove and the opposing end has at least one stop. The moveable pin is attached to the first wall of the top end of the handles and is moveable through an aperture in the first wall. In yet another further embodiment, the aperture in the second wall has a rim designed to fit around the groove of the moveable pin to thereby secure the pin the handle and the components. This is a snap fit lock mechanism. In a further embodiment, the means for securing the pin to the handles and the components can be of any design and mechanism.

BRIEF DESCRIPTION OF THE DRAWINGS

The accompanying drawings are included to provide a further understanding of the present invention. These drawings are incorporated in and constitute a part of this specification, illustrate one or more embodiments of the present invention and together with the description, serve to explain the principles of the present invention.

Among those benefits and improvements that have been disclosed, other objects and advantages of this invention will become apparent from the following description taken in conjunction with the accompanying drawings. The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention that may be embodied in various forms. The figures are not necessarily to scale, some features may be exaggerated to show details of particular components. Therefore, specific structural and functional details disclosed herein are not to be interpreted as limiting, but merely as a basis for the claims and as a representative basis for teaching one skilled in the art to variously employ the present invention.

Figure 1:
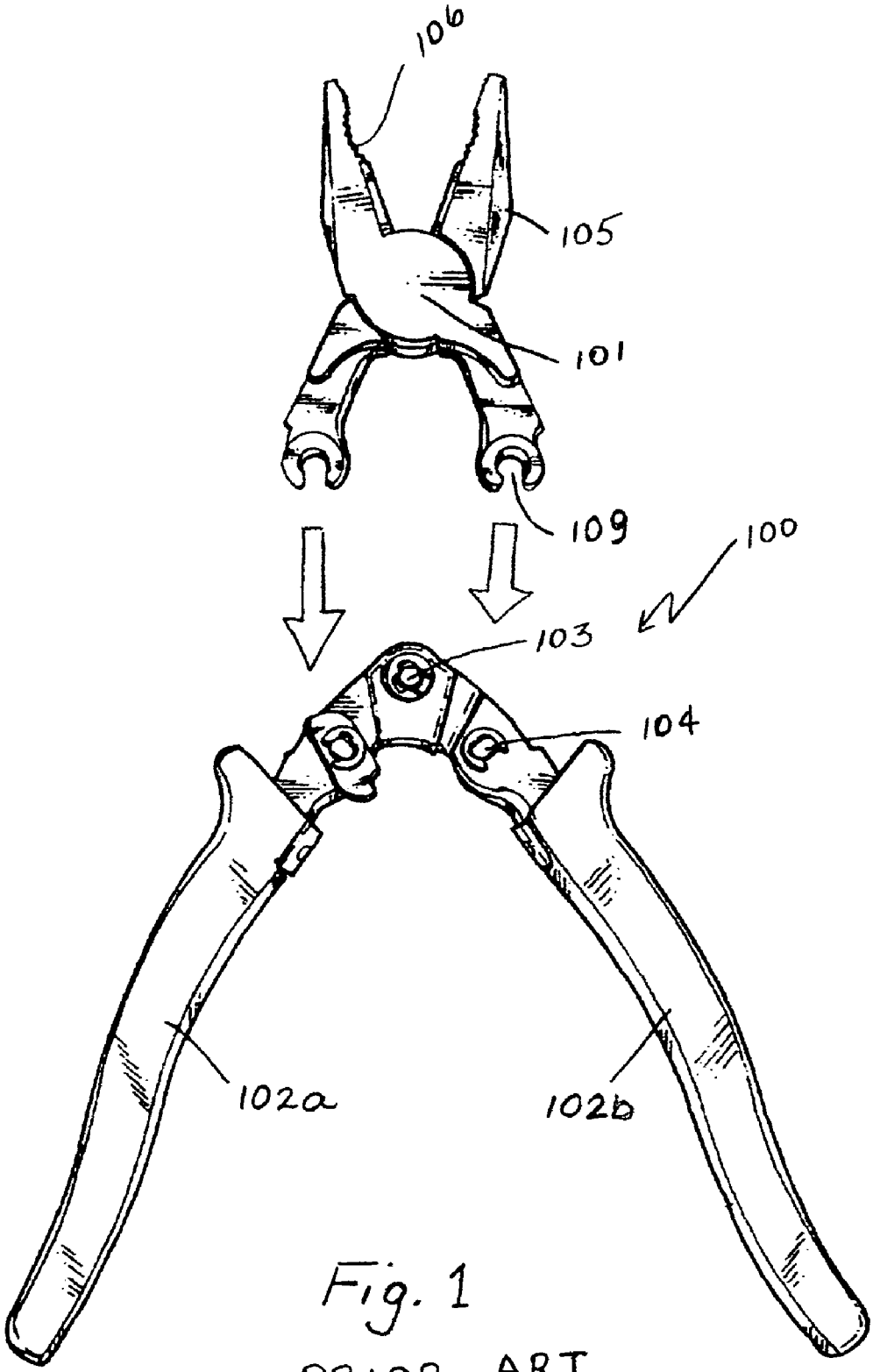
Fig. 1 PRIOR ART
FIG. 1 is an exploded view of a typical pliers device with interchangeable heads.

FIG. 1 illustrates the typical pliers device 100 with an interchangeable head 101, and more specifically, the device 100 has two handles 102*a* and 102*b*, respectively, connected at a pivot point 103 and at least two stationary pins 104. The head 101 has two components and each component has a top end 105 with a clamping surface 106 and a crescent shaped bottom 109. To install the head 101, the handles, 102*a* and *b*, must be pulled apart and the crescent shaped bottoms 109 are then attached to the stationary pins 104 and then the handles, 102*a* and *b*, are squeezed toward one another to secure the head 101 to the handles 102*a* and *b*. To remove the head 101, the handles, 102*a* and *b*, must again be pulled apart and the head 101 is pulled away from the handles, 102*a* and *b*, allowing the crescent shaped bottoms 106 to be detached from the stationary pins 104 and then the handles, 102*a* and *b*, are ready to receive another head.

Figure 2:
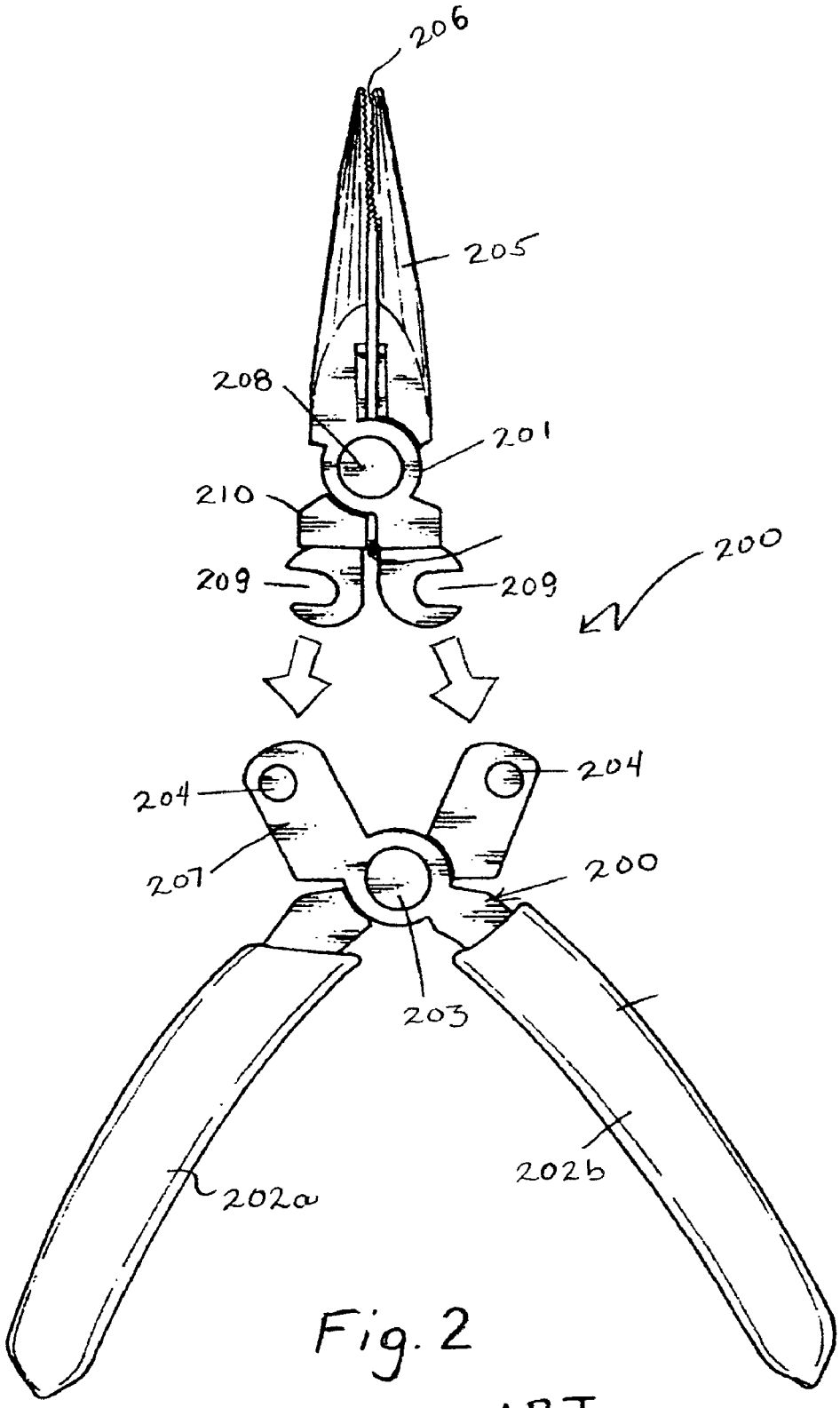
Fig. 2 PRIOR ART
FIG. 2 is an exploded view of the pliers device in U.S. Pat. No. 6,336,387 to Lee.

FIG. 2 illustrates the pliers device shown in U.S. Pat. No. 6,336,387 by Lee. Lee has two handles, 202*a* and *b* respectively, and the handles meet at a pivot point 203 and each handle has an extended portion 207 with a stationary pin 204. The portions 208 are situated above the pivot point 203. The interchangeable head 201 has two components and each component has a top end 205 with a clamping surface 206 and a crescent shaped bottom 209. To install the head 201, the handles, 202*a* and *b*, must be pulled apart and the crescent shaped bottoms 209 are then attached to the stationary pins 204 and then the handles, 202*a* and *b*, are squeezed toward one another to secure the head 201 to the handles 202*a* and *b*. To remove the head 201, the handles, 202*a* and *b*, must again be pulled apart and the head 201 is pulled away from the handles, 202*a* and *b*, allowing the crescent shaped bottoms 209 to be detached from the stationary pins 204 and then the handles, 202*a* and *b*, are ready to receive another head.

The main difference between FIG. 1 and FIG. 2 is that, in the Lee device (FIG. 2), the connection point for the head and the handle has been moved above the pivot point. However, the handles, 202*a* and *b*, still have to be moved or pulled apart to install and remove the head 201.

Figure 3:
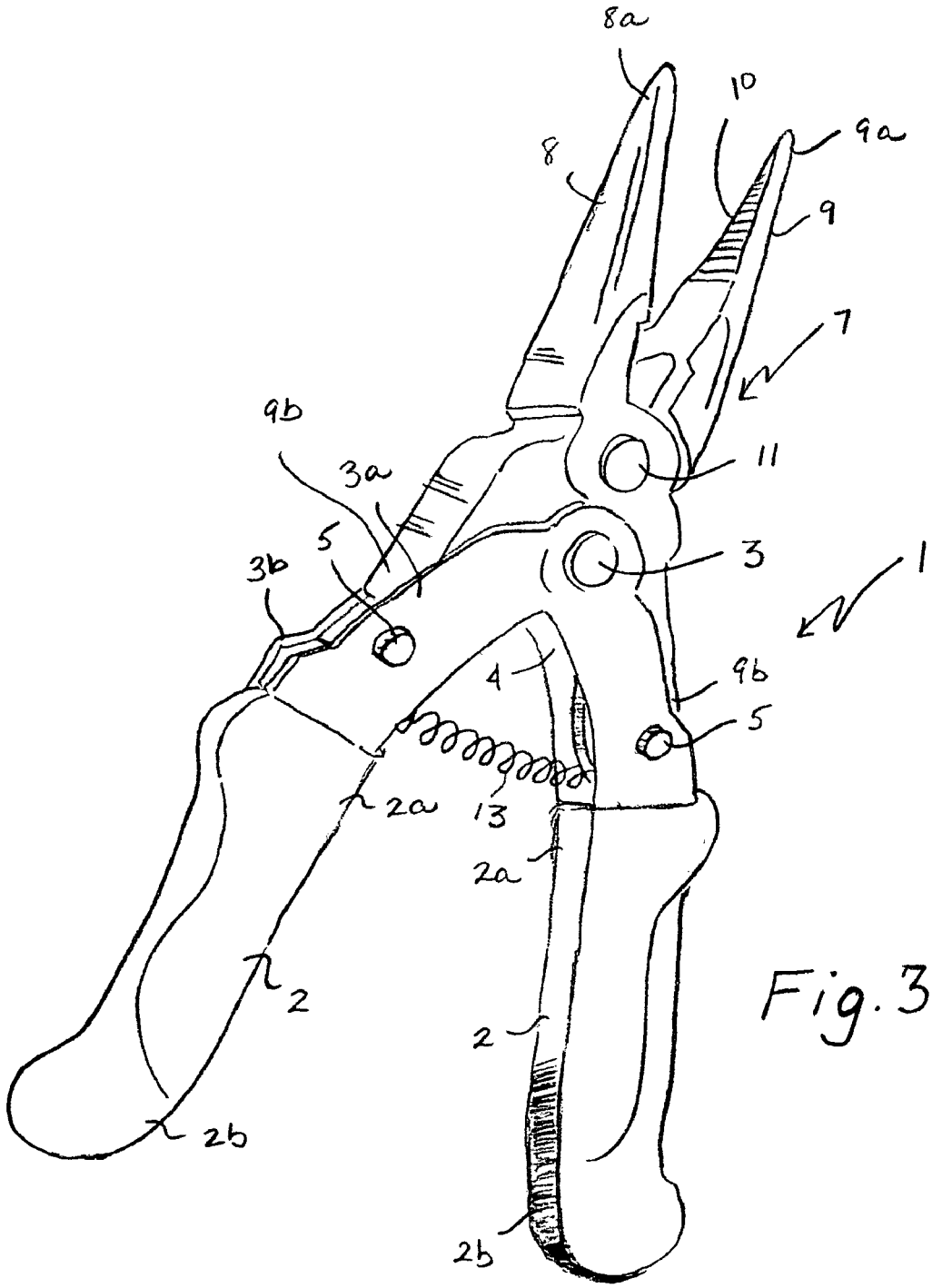
FIG. 3 is a front perspective view of one embodiment of the present invention, in particular, pliers device with interchangeable head in an open use position.
Figure 4:
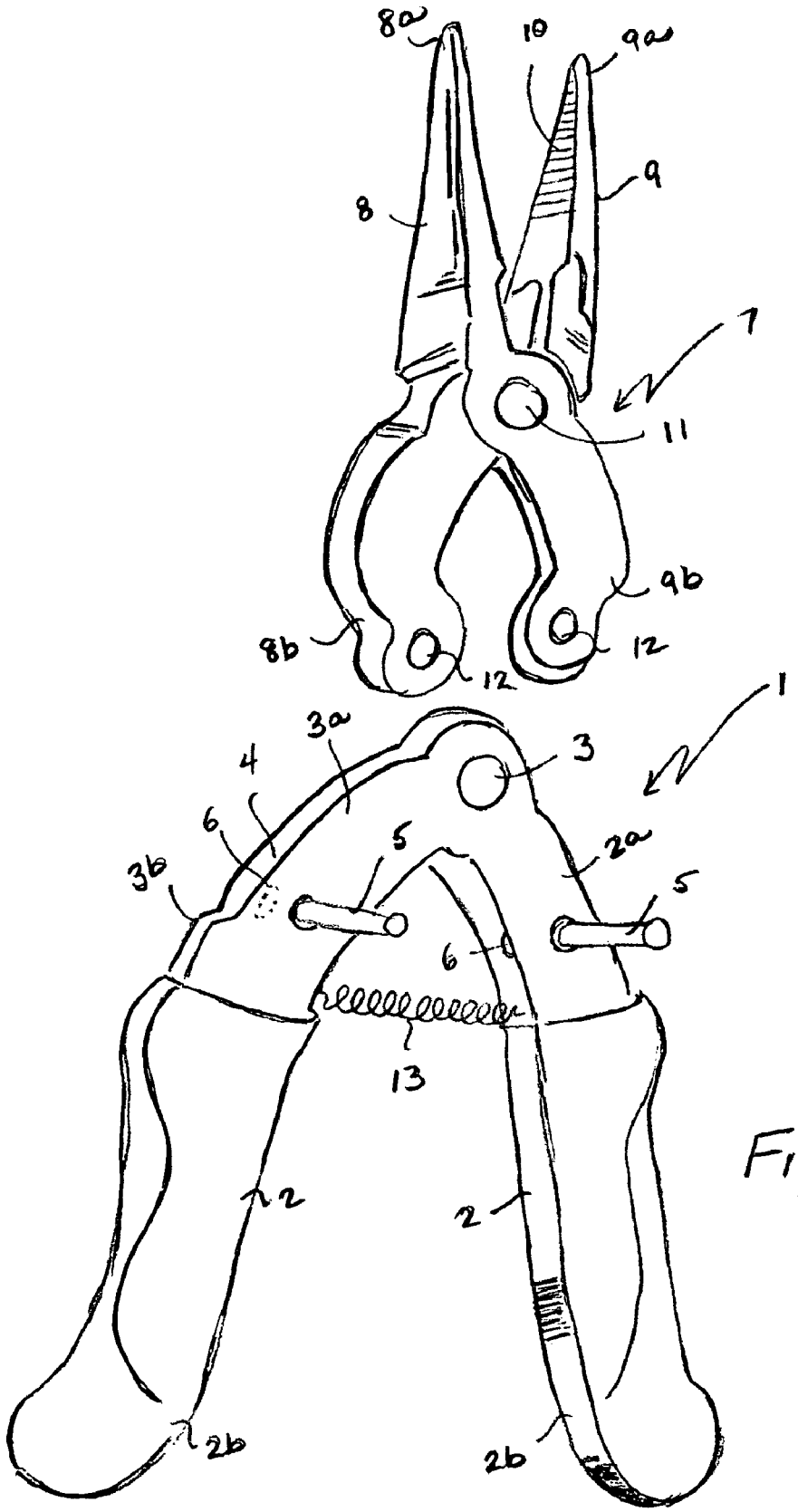
FIG. 4 is an exploded view of FIG. 1 showing the how the interchangeable head fits and is secured onto the handles of the pliers.
Figure 5:
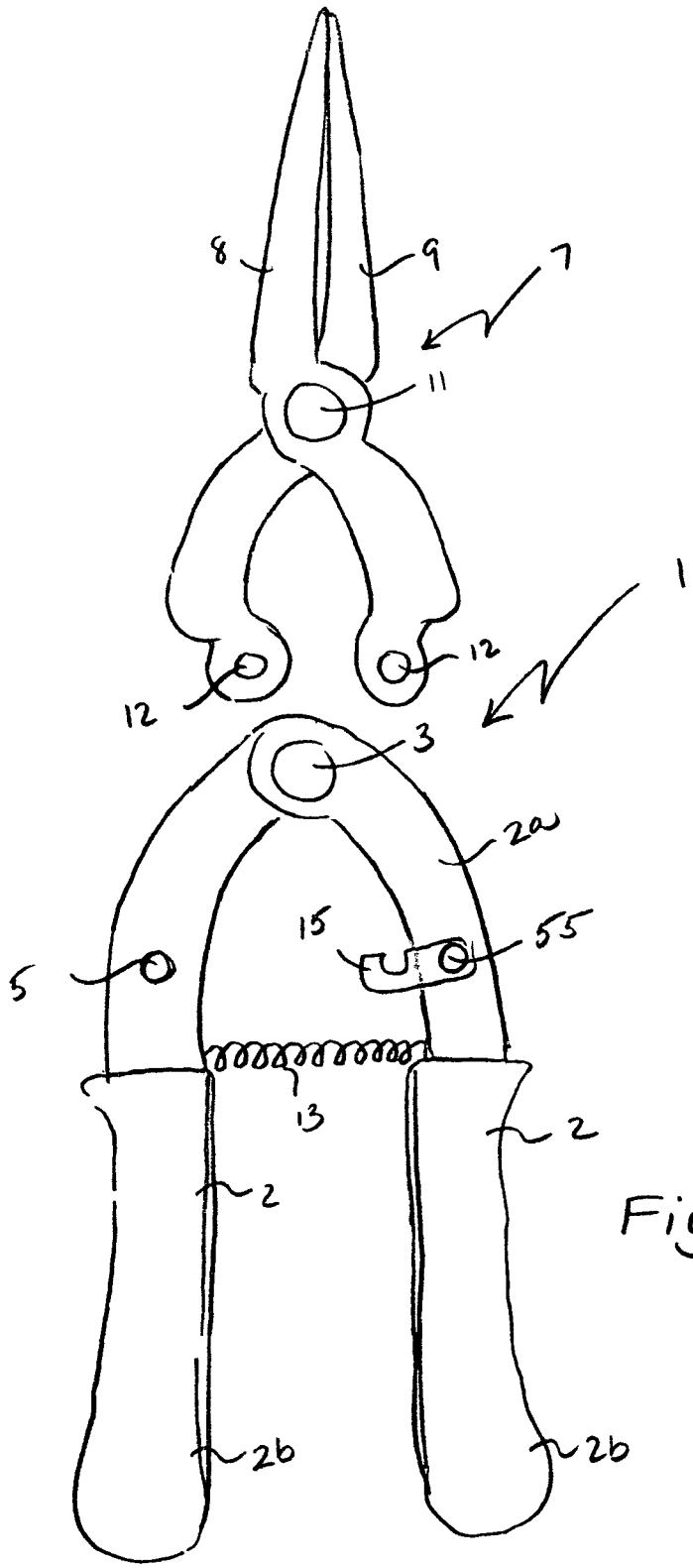
FIG. 5 is a front perspective view of FIG. 1 showing the device in a closed position.

Referring now to the drawings, FIGS. 3-5 show the embodiments of the pliers devices 1 of the present invention. Unlike the prior art, the present invention does NOT require opening or pulling the handles apart to install and remove the interchangeable head. The device 1 of the present invention comprises: a pair of handles 2 having opposing top and bottom ends, 2*a* and 2*b* respectively. The top end 2*a* of each of the handles 2 is connected at a pivot point 3, and each of the top ends 2*a* of the handles 2 have two generally parallel walls 3 forming a space 4 therebetween, and the first wall 3*a* has a moveable pin 5 attached therethrough and the second wall 3*b* has an aperture 6 to receive the moveable pin 5. The head 7 comprising a first and second component, 8 and 9 respectively, and each of the components has opposing top ends, 8*a* and 9*a*, and bottom ends, 8*b* and 9*b*. The top ends, 8*a* and 9*a*, of each of the components, 8 and 9, have at least one contact surface 10.

The first and second components, 8 and 9, are connected at a pivot point 11, and the bottom ends, 8*b* and 9*b*, of each of the components, 8 and 9, comprise at least one aperture 12 designed to align with the aperture 6 of the second wall 3*b* of one of the top ends 2*a* of the handle 2 and to receive the moveable pin 5 during an installment position.

Each of the bottom ends 8*b* and 9*b*, of the components of the head 7 is inserted within the space 4 formed by the walls 3 of the top ends of the handles 2, and the pin 5 is inserted through the aperture 12 of the bottom end of the head 7 and the aperture 6 of the top end of the handle 2.

The device 1 further comprises a means for securing the pin 5 to the handle 2 to thereby secure the head 7 to the handle 2. The handles 2 are designed to be squeezed together to thereby allow the contact surfaces 10 of the first and second top ends of the first and second components, 8 and 9, to move towards one another. The device 1 of the present invention further comprises a spring 13 situated between the handles 2.

The contact surfaces 10 of the device 1 function as clamping contact surfaces, and the device functions as a clamping device. Each of the contact surfaces 10 of the first and the second top ends of the first and second components, 8 and 9, comprise cutting surfaces and the device functions as a cutting device. The cutting device functions as snips by attaching a head with sharp cutting edges as contact surfaces 10.

The device 1 of the present invention further comprises a locking device 14 and one end of the locking device 14 is connected to one of the moveable pins 5*a*. The opposing end of the locking device 14 comprises at least one latch 55 and the latch 55 is designed to hook onto the second pin 5*b* during a locked position wherein the contact surfaces of the first and second components of the head 7 are connected to one another.

Figure 6:
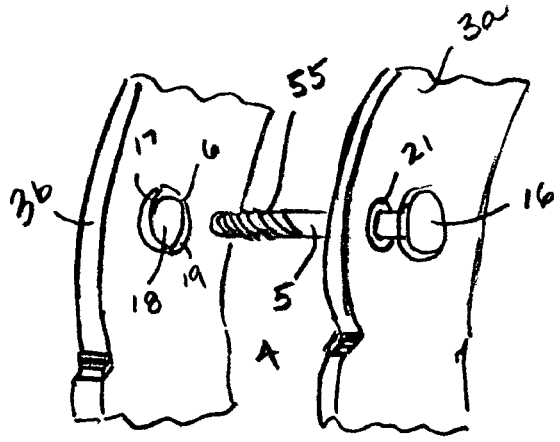
FIG. 6 is an exploded view of the screw and twist lock mechanism of one of the embodiments of the present invention.
Figure 7:
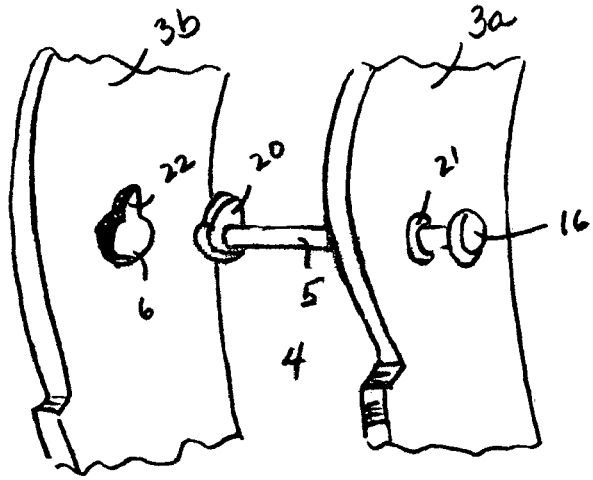
FIG. 7 is an exploded view of the lock and key mechanism of another embodiment of the present invention.
Figure 8:
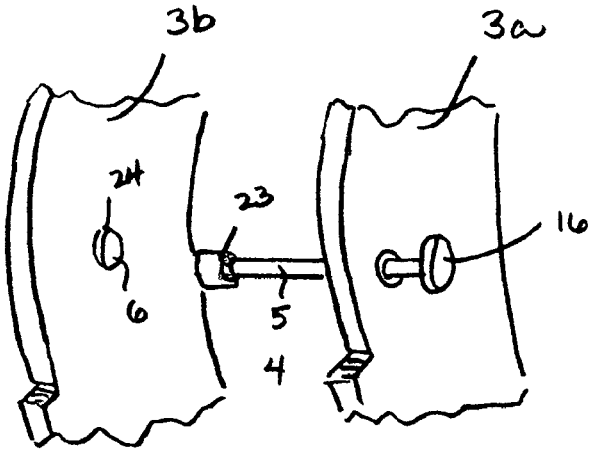
FIG. 8 is an exploded view of the snap and lock mechanism of a further embodiment of the present invention.

FIGS. 6-8 relate to the pin securing devices of the present invention. FIG. 6 uses a screw and/or twist mechanism. The moveable pin 5 has opposing ends, 5*a* and b respectively, one end 5*a* has a threaded portion 15 and the opposing end 5*b* has at least one stop 16. The moveable pin 5 is attached to the first wall 3*a* of the top end of the handles 2 and is moveable through an aperture 21 in the first wall 3*a*. The second wall 3*b* comprises a cap 17 with a cavity 18 having grooves 19 for receiving the threaded portion 15 of the moveable pin 5 during an installed position. In yet another embodiment, the second wall 3*b* has an aperture 6 leading to a cap 17 with a cavity 18 having grooves 19 for receiving the threaded portion 15 of the moveable pin 5 during an installed position. The stop 16 of the pin 5 is also designed to secure the pin 5 into the aperture 6 of the second wall 3*b*.

FIG. 7 uses a lock and key mechanism. The moveable pin 5 has opposing ends, 5*a* and *b*, one end 5*a* has an extended portion 20 and the opposing end 5*b* has at least one stop 16. The moveable pin 5 is attached to the first wall 3*b* of the top end of the handles 2 and is moveable through an aperture 21 in the first wall 3*b*. In still another further embodiment, the second wall 3*b* of the top end of the handles 2 and the bottom end of each of the components comprise apertures, 6 and 12, with an extended cavity 22 designed to fit the extended portion 20 of one end of the pin 5. The pin 5 with the extended portion 20 is inserted into the apertures, 6 and 12, with extended cavity 22 and then the pin 5 is secured with a lock and key mechanism.

FIG. 8 relates to use of a snap fit mechanism. The moveable pin 5 has opposing ends, 5*a* and *b* respectively, one end 5*a* has a groove 23 and the opposing end 5*b* has at least one stop 16. The moveable pin 5 is attached to the first wall 3*a* of the top end of the handles 2 and is moveable through an aperture 21 in the first wall. The aperture 6 in the second wall has a rim 24 designed to fit around the groove of the moveable pin 5 to thereby secure the pin 5 to the handle 2 and the components, 8 and 9. The means for securing the pin to the handles and the components can be of any design and mechanism.

Numerous modifications and variations of the present invention are possible in light of the above teachings. It is therefore to be understood that within the scope of the attendant claims attached hereto, this invention may be practiced otherwise than as specifically disclosed herein.

What is claimed is:

1. A device having an interchangeable head, said device comprising:

a pair of handles having opposing top and bottom ends, said top end of each of said handles being connected at a pivot point, each of said top ends of said handles having two generally parallel walls defining first and second walls and forming a space therebetween, each of said parallel walls having an aperture, said apertures on said first and second walls being aligned with one another, each of said apertures on each of said second walls having an extended cavity, each of said first walls having a moveable pin attached therethrough, each of said pins having opposing sides, a first side of each of said pins having a stop and a second side of each of said pins having an extended portion, said extended portion of each of said pins being adapted to be received by said extended cavity of each of said second walls, said aperture of each of said first walls having a size smaller than the size of said stops and said extended portions thereby allowing said pins to be movable within said parallel walls, said stops and said extended portions preventing said pins from being removed from said first walls; and a head comprising a first and second components, each of said components having opposing top and bottom ends, said top end of each of said components having at least one contact surface, said first and second components being connected at a pivot point, said bottom end of each of said components comprising at least one aperture, said head aperture is adapted to receive said pin and its extended portion and said extended portion of said pin then passes through said aperture with extended cavity on said second wall and is then turned to secure said head onto said handles, said handles are designed to be squeezed together to thereby allow said contact surfaces of said first and said second top ends of said first and second components to move towards one another.

2. The device of claim 1 further comprising a spring situated between said handles.

3. The device of claim 1 wherein said contact surfaces function as clamping contact surfaces, said device functions as a clamping device.

4. The device of claim 3 wherein said clamping device functions as pliers.

5. The device of claim 1 wherein each of said contact surfaces of said first and said second top ends of said first and second components comprise cutting surfaces, said device functions as a cutting device.

6. The device of claim 5 wherein said cutting device functions as snips.

7. The device of claim 5 wherein said cutting device functions as scissors.

8. The device of claim 1 further comprising a locking device, one end of said locking device being connected to the moveable pin of one of said pair of handles.

9. The device of claim 8 wherein an opposing end of said locking device comprises at least one latch, said latch designed to hook onto the pin of the other one of said pair of handles during a locked position wherein said contact surfaces of said first and second components of said head are connected to one another.

* * * * *